US008579681B2

(12) United States Patent
Andrews et al.

(10) Patent No.: US 8,579,681 B2
(45) Date of Patent: Nov. 12, 2013

(54) ROTARY DRESSING TOOL CONTAINING BRAZED DIAMOND LAYER

(75) Inventors: Richard M. Andrews, Westborough, MA (US); Sergej-Tomislav Buljan, Acton, MA (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 0 days.

(21) Appl. No.: 13/487,689

(22) Filed: Jun. 4, 2012

(65) Prior Publication Data

US 2012/0244791 A1 Sep. 27, 2012

Related U.S. Application Data

(60) Division of application No. 11/446,099, filed on Jun. 2, 2006, now Pat. No. 8,192,256, which is a continuation of application No. 09/126,806, filed on Jul. 31, 1998, now abandoned.

(51) Int. Cl.
*B24B 21/18* (2006.01)

(52) U.S. Cl.
USPC ..... 451/443; 451/359; 451/548; 125/11.01

(58) Field of Classification Search
USPC ..... 451/56, 259, 359, 443, 541, 547, 548; 125/11.01, 11.02, 11.03, 11.1
See application file for complete search history.

(56) References Cited

U.S. PATENT DOCUMENTS

| | | | |
|---|---|---|---|
| 2,072,051 | A | 8/1935 | der Pyl et al. |
| 2,557,042 | A | 12/1951 | Speicher |
| 3,178,273 | A | 4/1965 | Libal |
| 3,742,654 | A | 7/1973 | Darrow et al. |
| 3,802,130 | A | 4/1974 | Lindenbeck |
| 3,894,673 | A | 7/1975 | Lowder et al. |
| 4,018,576 | A | 4/1977 | Lowder et al. |
| 4,199,903 | A | 4/1980 | Fitzpatrick |
| 4,658,800 | A | 4/1987 | Larsson |
| 4,677,962 | A | 7/1987 | Loos et al. |
| 4,685,440 | A | 8/1987 | Owens |

(Continued)

FOREIGN PATENT DOCUMENTS

| | | |
|---|---|---|
| CA | 1086509 | 9/1980 |
| DE | 3811784 A1 | 7/1989 |

(Continued)

OTHER PUBLICATIONS

Murakawa et al, "Forming of a Grinding Wheel Using a Dresser With Brazed Diamond Film", Materials Science and Engineering, A140 (1991) pp. 759-763, Netherlands.

*Primary Examiner* — Eileen P. Morgan
(74) *Attorney, Agent, or Firm* — Joseph P. Sullivan; Abel Law Group, LLP

(57) ABSTRACT

A disc-shaped, rotary dressing tool has a rigid core and an abrasive rim around at least one surface of the periphery of the rigid core. The rigid core and the abrasive rim are oriented in a direction orthogonal to the axis of rotation of the tool. In an embodiment, the abrasive rim comprises an abrasive component bonded to the rigid core by means of an active braze. The abrasive component can be diamond grains arranged in a single layer or diamond film inserts. In a particular embodiment, the abrasive component can comprise a plurality of abrasive inserts mechanically fastened to the rigid core. In another embodiment, the abrasive rim can comprise strips of an abrasive component with each strip being filled into slots machined into and through the perimeter of the core.

16 Claims, 2 Drawing Sheets

(56) References Cited

U.S. PATENT DOCUMENTS

| | | | |
|---|---|---|---|
| 4,696,130 | A | 9/1987 | Belthle |
| 4,799,472 | A | 1/1989 | Tonshoff et al. |
| 4,799,473 | A | 1/1989 | Erhardt et al. |
| 4,805,586 | A | 2/1989 | Borse |
| 4,826,509 | A | 5/1989 | Schwammle |
| 4,860,721 | A | 8/1989 | Matsuda |
| 4,915,089 | A | 4/1990 | Ruark et al. |
| 4,968,326 | A | 11/1990 | Wiand |
| 5,011,511 | A | 4/1991 | Beck |
| 5,058,562 | A | 10/1991 | Tsutsui et al. |
| 5,289,815 | A | 3/1994 | Krenzer |
| 5,314,652 | A | 5/1994 | Simpson et al. |
| 5,492,771 | A | 2/1996 | Loweder et al. |
| 5,505,750 | A | 4/1996 | Andrews |
| 5,679,404 | A | 10/1997 | Patten, Jr. et al. |
| 5,679,446 | A | 10/1997 | Windischmann |
| 5,832,360 | A | 11/1998 | Andrews et al. |
| 5,842,912 | A | 12/1998 | Holzapfel et al. |
| 5,916,013 | A | 6/1999 | Naumann et al. |
| 5,951,378 | A | 9/1999 | Miller et al. |
| 6,123,612 | A | 9/2000 | Goers |
| 6,190,240 | B1 | 2/2001 | Kinoshita et al. |
| 6,193,593 | B1 | 2/2001 | Miller et al. |
| 6,206,766 | B1 | 3/2001 | Schuller |
| 6,224,473 | B1 | 5/2001 | Miller et al. |
| 6,312,324 | B1 | 11/2001 | Mitsui et al. |
| 6,371,838 | B1 | 4/2002 | Holzapfel |
| 6,679,243 | B2 | 1/2004 | Sung |

FOREIGN PATENT DOCUMENTS

| | | | |
|---|---|---|---|
| EP | 0116668 | A1 | 8/1984 |
| EP | 0422778 | A1 | 4/1991 |
| FR | 2169577 | | 9/1973 |
| JP | 63114880 | A1 | 5/1988 |
| JP | 5039661 | A | 2/1993 |
| JP | 8192359 | A1 | 7/1996 |
| JP | 8216019 | A1 | 8/1996 |
| WO | 98/51447 | | 5/1997 |

ROTARY DRESSING TOOL CONTAINING BRAZED DIAMOND LAYER

PRIORITY CLAIM AND CROSS-REFERENCE TO RELATED APPLICATIONS

This application is a divisional of and claims priority to U.S. patent application Ser. No. 11/446,099 filed on Jun. 2, 2006 now U.S. Pat. No. 8,192,256, and entitled "Rotary Dressing Tool Containing Brazed Diamond Layer," and naming Richard M. Andrews and Sergej T. Buljan as inventors, which is a continuation of U.S. patent application Ser. No. 09/126,806 filed on Jul. 31, 1998 now abandoned, and entitled "Rotary Dressing Tool Containing Brazed Diamond Layer," and naming Richard M. Andrews and Sergej T. Buljan as inventors, which are both incorporated by reference herein in their entirety.

This invention relates to rotary dressing tools designed for truing and dressing the profiled faces of abrasive grinding wheels.

BACKGROUND OF THE INVENTION

Rotary diamond dressing tools impart the required form onto a grinding wheel and must be designed and made to specifications driven by the design of the grinding wheel. These tools have narrow quality specifications with low tolerances for deviations in geometry and mechanical attributes. Although dressing tools have been constructed in a variety of ways utilizing various materials and processes, most processes known in the art are demanding and inefficient.

For example, in one commercial process, diamond grains are hand set into a pattern in the cavity of a mold with an adhesive, then a powdered metal bond material is added and pressed into place around the diamonds. The pressed materials are densified by processes such as infiltration, hot pressing, sintering, or a combination thereof, to fix the diamonds in place and form the tool. In another typical process, a diamond layer may be• set onto a custom designed mold and fixed in place by reverse electroplating. See, e.g., U.S. Pat. No. 4,826,509. The sintering or plating step is followed by an extensive grinding step to remove grain high spots and to flatten the surface.

In another process described in U.S. Pat. No. 4,805,586, the diamond grains are pretreated to roughen and enlarge their surface area and to permit the grains to be arranged within the bond so that the majority of the grains are in direct contact with adjacent grains. These pretreated diamond grains are then electroplated to the surface of a base body with nickel or cobalt or alloys of nickel or cobalt.

In U.S. Pat. No. 5,505,750, the diamond grains and metal powder bond are infiltrated with a near-eutectic copper-phosphorus composition during sintering.

Many powder metal matrix abrasive components for dressing tools utilize relatively small diamond grains (e.g., less than 0.5 mm in diameter) embedded within the powder matrix and the resulting composite is ground to the required geometry. Such abrasive components are not very sharp and grinding wheel dressing with them is relatively inefficient due to rapid wear of the tool. When such a powder matrix is used with large diamond grains, the finishing process loses considerable amounts of diamond as the composite is ground to the required geometry. It is not possible to achieve a durable, fine (e.g., about 0.127 mm (0.005 inch)) dressing tip radius in tools made from diamond grains in a powder metal bond.

Poly crystalline diamond (PCD) inserts have been used to construct rotary dressing tools. PCD inserts are embedded in a powder metal matrix, sintered onto the tool, and then ground to the required geometry and surface finishing. See, e.g., U.S. Pat. No. 4,685,440. PCD inserts offer a relatively flat surface and can be easily ground to the required geometry during finishing operations, or, for some shapes, can be provided as a near net shape piece. However, PCD is not 100% diamond. PCD material initially contains significant quantities (10-12 wt %) of metal catalyst and the metal catalyst is typically leached from the PCD material, leaving voids, to yield essentially pure diamond with a density of about 90 to 95% of the theoretical density. Therefore, dressing tools made with PCD inserts lack the durability of dressing tools made with diamond abrasive grains which are fully dense, 100% diamond materials.

The rotary diamond tool for dressing abrasive wheels described in U.S. Pat. No. 5,058,562 is made by using a chemical vapor deposition (CVD) process to deposit a layer of diamond film directly onto a base plate of the tool and assembling the base plate with a pair of backup plates to provide stiffness. With this approach, there are no diamond cutting points created, merely a hard, flat diamond surface. In a dressing tool, a flat diamond surface merely acts to crush the wheel face, rather than to cut bond and spent abrasive grains from the face and, thereby, open the face of the wheel for further grinding.

The rotary diamond tool for dressing abrasive wheels described in U.S. Pat. No. 4,915,089 is made by forming a single layer of diamond grains in a plane orthogonal to the rotational axis of the tool. The layer of diamond grains is sandwiched between two layers of metal backup plates. The diamond layer is bonded to the plates by hot pressing the diamond grains and metal powder between the metal backup plates in a suitable mold to sinter the metal powder. The U.S. Pat. No. 4,915,089 mentions an alternative design wherein diamond grains are attached to one or both sides of the tool by plating or metal bonding, but teaches that the alternative design suffers the disadvantage of poor diamond retention. In the preferred design, arcurate segments of the laminated assembly of diamond grains and plates are brazed to the circumference of a disc-shaped metal wheel to form a dressing tool, optionally with a continuous abrasive rim. However, consistent with the geometry of this tool design, the patent teaches that the tool is used to dress a straight face wheel and the tool would not be useful for dressing a profile into the face of a grinding wheel.

EP-B-116668 discloses a dressing tool having a single layer of electroplated diamond grains arranged in a geometric design similar to that of the tool of U.S. Pat. No. 4,915,089. In contrast to the active braze bond used in the tools of the invention, with the electroplated bond of the EP-B-116668 tool, poorer diamond grains retention, shorter tool life and higher manufacturing costs are predicted.

SUMMARY OF THE INVENTION

The invention is a rotary profile dressing tool having a rigid, disc-shaped core and an abrasive rim around at least one surface of the periphery of the core, the core and the abrasive rim being oriented in a direction orthogonal to the axis of rotation of the tool, wherein the abrasive rim comprises an abrasive component bonded to the core by means of an active braze, and the abrasive component is selected from the group consisting of diamond grains arranged in a single layer and diamond film inserts, and combinations thereof. In an alternative design, the abrasive rim comprises a plurality of abrasive inserts mechanically fastened to the core of the tool, and the abrasive inserts comprise an abrasive component bonded to a backing element by means of an active braze, and the abrasive component is selected from the group consisting of diamond grains arranged in a single layer and diamond film inserts, and combinations thereof.

DESCRIPTION OF THE PREFERRED EMBODIMENTS

Figure 1:
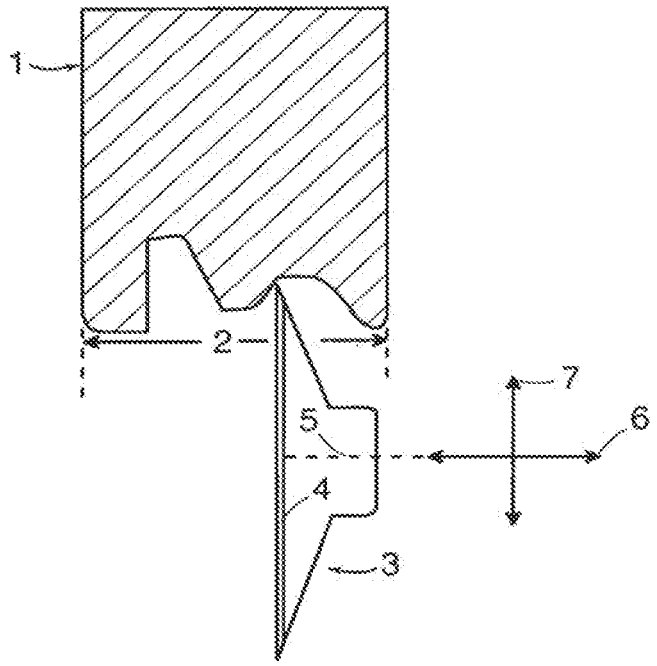
FIG. 1 is an illustration of the operation of a rotary profiling dresser of the invention showing a grinding wheel with a profiled grinding face.

As .shown in FIG. 1, the dressing tools of the invention are effective in profile dressing and truing operations carried out on abrasive grinding wheels. The dressing tool 3 is rotated about an axis (depicted in FIG. 1, with a dashed line numbered 5) and moved into contact with the profiled face 2 of the grinding wheel 1 in a direction along either an X axis (arrow 6) or a Y axis (arrow 7.) as needed to dress or true the profile of the wheel.

As used herein, "true" (or truing) refers to operations used to make a grinding wheel round and profiled into the desired contours. Dress or dressing refers to operations used to open the grinding surface (or face) of the grinding wheel to improve grinding efficiency and avoid workpiece burn or other damage caused as the wheel face dulls during grinding. The wheel face dulls; for example, when the exposed sharp abrasive grains have been consumed, or the wheel face becomes smooth due to failure of the bond to erode and expose new grain or due to loading of the wheel face with debris from grinding operations.

Some operations permit a single dressing tool to be used simultaneously for both purposes and others do not. Truing is generally required when a grinding wheel is first mounted on a machine for use and whenever operations cause the wheel to go out of round or lose its contour. Depending upon the particular grinding operation, the dressing tools of the invention may be used to true or-to dress or to do both.

Figure 2:
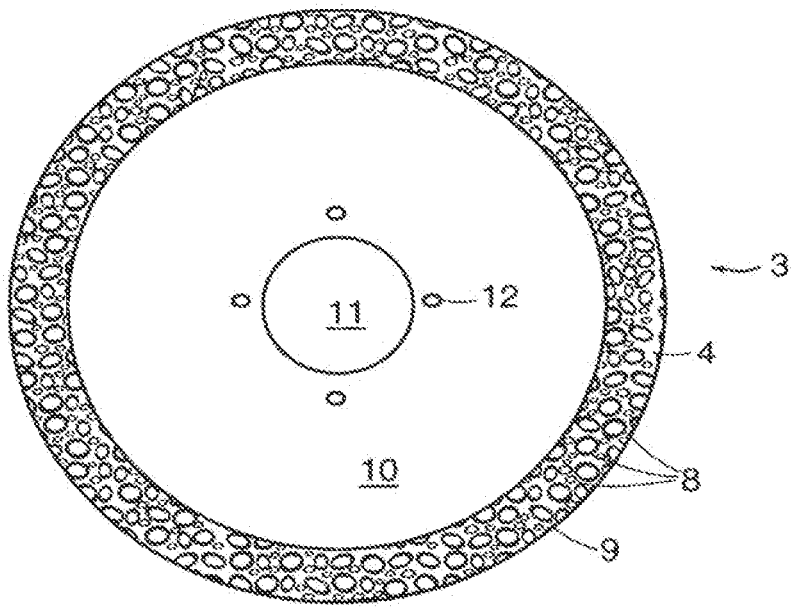
FIG. 2 is a planar view of a rotary profile dressing tool of the invention.

A typical rotary dressing tool of the invention is illustrated in planar view in FIG. 2. A single layer of the diamond grain 8 is embedded in a metal braze 9 and bonded to the metal core 11 of the tool. The metal core of the tool contains a central hole for mounting the tool onto a drive spindle of a machine equipped with a means for rotating the tool around an axis 5. Also depicted in FIG. 2 is an optional feature of the invention consisting of four holes 12 around the central arbor hole for attaching the metal core of the tool to a support element (not shown).

Figure 3:
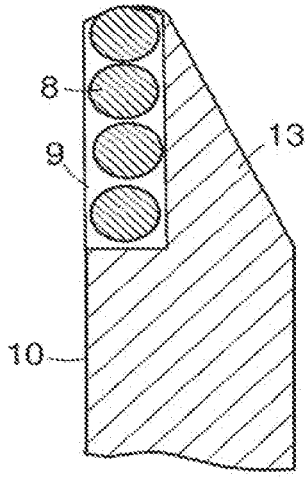
FIG. 3 is a partial cross-section of a single layer of diamond abrasive grain brazed onto a backing element in the rotary profile dressing tool of the invention.
Figure 4:
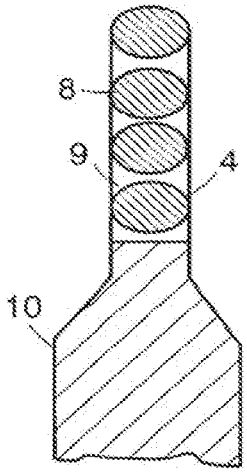
FIG. 4 is a partial cross-section of a single layer of diamond abrasive grain brazed onto a rotary profile dressing tool of the invention without a backing element.
Figure 5:
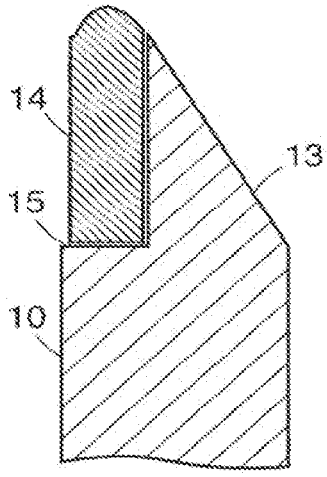
FIG. 5 is a partial .cross-section of a diamond film insert brazed onto a backing element in the rotary profile dressing tool of the invention.

As shown in FIGS. 3-5, the abrasive rim 4 of the dressing tool 3 may be constructed in one of several preferred embodiments. In FIG. 3, the abrasive grain 8 and braze 9 are supported by a backing element 13 which is part of the unitary construction of the metal core 10. The rotary profile dressing tool may comprise a rigid, disc-shaped core comprising an inner portion having a substantially uniform thickness; and a tapered backing portion extending from the inner portion and extending circumferentially around an outer perimeter of the inner portion, wherein the tapered portion comprises a first surface and a second surface and an angle between the first surface and the second surface defines an angle at an outermost point of the tapered backing portion within a range between about 15° and about 30° ; and an abrasive rim defining an outer perimeter of the tool and connected to the first surface of the tapered backing portion, the first surface extending substantially orthogonal to an axis of rotation of the tool, and wherein the abrasive rim is further connected to a first surface of the inner portion, the first surface of the tapered backing portion and the first surface of the inner portion connected at a substantially orthogonal angle relative to each other and defining a recess containing the abrasive rim, and further wherein the abrasive rim comprises an active braze and diamond grains arranged in a single layer. In FIG. 4, the abrasive grain 8 and the braze 9 are self-supporting and• are brazed to the metal core 10 only along the inner diameter of the abrasive rim 4. Such a construction has the advantage that the dressing tool having exposed abrasive grain on each side of the tool may be operated in either direction along the X axis (arrow 6) so as to approximately double the efficiency of the dressing operation and, thus, to generate profiles previously unobtainable with a single tool setup.

In either construction, after brazing, the diamond grains 8 are submerged within the braze 9 layer and are not necessarily visible in the manner of metal bonded single layer abrasive cutting tools. Such a self-supporting abrasive component cannot be constructed if utilizing an electroplating process to bond the abrasive grain to the core of the dressing tool because the electroplated metal diamond composite would lack sufficient strength to be used. It is only possible when making a brazed single layer diamond abrasive tool utilizing an active braze wherein the diamond grains function as a structural element of the tool, as described herein.

As shown in FIG. 5, a diamond film insert 14 may be bonded to the metal core 10 with an active braze 15 to construct a preferred embodiment. The rotary profile dressing tool may comprise a rigid, disc-shaped core comprising an inner portion having a substantially uniform thickness; and a tapered backing portion extending from the inner portion and extending circumferentially around an outer perimeter of the inner portion, wherein the tapered portion comprises a first surface and a second surface and an angle between the first surface and the second surface defines an angle at an outermost point of the tapered backing portion within a range between about 15° and about 30° ; and an abrasive rim defining an outer perimeter of the tool and connected to the first surface of the tapered backing portion, the first surface extending substantially orthogonal to an axis of rotation of the tool, and wherein the abrasive rim is further connected to a first surface of the inner portion, the first surface of the tapered backing portion and the first surface of the inner portion connected at a substantially orthogonal angle relative to each other and defining a recess containing the abrasive rim, and further wherein the abrasive rim comprises diamond film inserts. As used herein, diamond film refers to a thin layer of material made by a CVD or jet plasma process, with or without diamond seed particles, consisting of approximately 100% diamond. Examples of diamond film preparations are provided in U.S. Pat. No. 5,314,652; U.S. Pat. No. 5,679,404; and U.S. Pat. No. 5,679,446 which are hereby incorporated by reference. The diamond film is made into a thin layer (e.g., 100 to 1,000 microns) having the desired size for a tool insert and then the diamond film insert is brazed to the backing element 13 portion of the metal core 10 in substantially the same manner, and with the same types of brazes, as the diamond abrasive grains are brazed to the metal core.

These preferred embodiments differ from the prior art in several significant ways. The abrasive components depicted in FIGS. 3-5 require less drastic finishing operations to achieve the precise surfaces desired for dressing tools. Like PCD inserts, diamond film inserts (FIG. 5) are flat films. As for the single layer diamond abrasive grain embodiments (FIGS. 3 and 4), some initial grinding of the surface may be needed, but the single layer .of grain eliminates much of the uneven character of a composite matrix of abrasive grain in a powdered metal bond.

The dressing tools of the invention are designed to present the same tip radius to the wheel face throughout the life of the dressing tool because the width of the single layer of diamond grain (or the diamond film insert) is not affected by the dressing operation. As the outermost diamond grain is consumed, a single grain below it is present at the radial tip of the dressing tool and the radius of the dressing tip remains constant as the tool is used. Thus, the tools of the invention are self-sharpening and maintain a precise geometry as they are consumed.

In further contrast to the prior art tools, the dressing tools of the invention have a long life and superior efficiency in dressing and truing grinding wheels.

The angle of the backing element may range from 0 to 90°, preferably from 10 to 45°, and most preferably ranges from 15 to 30° in dressing tools designed for use on vitrified grinding wheels.

In constructing the tools of the invention, brazing is typically carried out at 600-900° C., utilizing an active braze, and preferably at 800-900° C. utilizing an active bronze or nickel braze. An "active braze" is a braze containing at least one material (e.g., titanium or chromium) that is chemically reactive with the surface of the diamond grain. When heated, the braze creates a chemical bond between the braze material, the diamond grain, and, optionally the metal core of the tool. A preferred active bronze braze is made from a mixture of copper, tin and titanium hydride powders, optionally with the addition of silver powder, by the method described in commonly owned U.S. Ser. No. 08/920,242, filed Aug. 28, 1997, the contents of which are hereby incorporated by reference. A preferred active braze comprises 55 to 25 79 wt % copper, 15 to 25 wt % tin and 6 to 20 wt % titanium.

Another preferred active braze suitable for use in the invention is• a nickel braze, comprising 60 to 92.5 wt % nickel, preferably 70 to 92.5 wt % nickel, and 5 to• 10 wt % chromium, 1.0 to 4.5 wt % boron, 1.0 to 8.0 wt % silicon and 0.5 to 5.0 wt % iron. The nickel braze optionally comprises other materials, such as 0.1 to 10 wt % tin.

The rigid, disc-shaped core is constructed of a wear resistant material having a use life complementary to the life of the diamond abrasive component. Steel, particularly tool steel, tungsten carbide, iron, cobalt, and composites thereof and combinations thereof, are suitable for use in the core. Steel is preferred. Suitable composites include ceramic particles or fibers contained in a metal matrix continuous phase. The core may be molded or machined into the desired tool dimensions by 5 methods well known in the art.

FIGS. 2-5 show a continuous abrasive rim construction. In an alternative embodiment, the abrasive component is inserted as strips along the metal core. The strips may rest within indentations upon a backing element, or they may be filled into slots machined into and through the perimeter of the metal core.

In another embodiment of the invention (not shown in the drawings) the layer of brazed diamonds is present as a plurality of offset strips located alternately on the periphery of either of the two sides of the rigid core. In this zig-zag configuration, the periphery of the rigid core appears fluted and the diamond is brazed in strips within the indentations of the fluted periphery.

In another embodiment of the invention (not shown the drawings) the diamond is brazed to a backing element to form an abrasive insert and a plurality of the abrasive inserts are mechanically fastened (e.g., bolted) to the periphery of the rigid core.

Other embodiments are suited for use in the rotary profile dressing tools of the invention, provided the diamonds are oriented such that a set of diamond grains at any given point around the periphery of the tool is presented to the face of the wheel as a single cutting point and, as this single diamond point is worn, the set of remaining diamond grains consecutively presents another diamond grain to replace the worn one and become the single cutting point until the set has been exhausted.

EXAMPLE 1

A test tool was constructed from a 10 cm (4 inch) outer diameter stainless steel (304L) core by vacuum brazing approximately 100% concentration of SDA 100+ diamond grit (425 to 500. microns, obtained from DeBeers) onto a 20° included angle backing element on the rim of the core. The tool was designed to yield a dressing tip radius of about 0.25 mm (0.01 inch), a radius approximately equal to the radius of the diamond grit selected for the tool after a minor amount of grinding to finish the abrasive component to the desired initial dressing tip radius.

Brazing• was carried out at 880° C. utilizing an active bronze braze. The active bronze braze was made from a mixture of 100 parts by weight of 77/23 copper/tin alloy powder and 10 parts by weight of titanium hydride powder. The powder mixture was blended at 13 wt % with Braz™ organic binder to make a paste composition, and the paste was spread onto designated portions of the rim of the metal core of the tool. Diamond grain was dusted onto the paste in a single layer and excess diamond grain was shaken off of the tool. The tool was oven dried to evaporate the water from the binder and the dried tool was heated to 880° C. for 30 minutes under a low oxygen atmosphere at less than 0.133 Pa ($<10^{-3}$ Torr) pressure, and then permitted to cool. In the finished tool, the braze contained 70.2 wt % copper, 21.0 wt % tin and 8.8 wt % titanium.

A second tool was made in the same fashion, except that the dressing tip radius was 0.12 mm (0.005 inch) and the diamond grit size was 0.212 to 0.25 mm.

The 0.25 mm (0.01 inch) tip radius tool was tested in a commercial setting on thread grinders. The grinding wheels were 46×1.3×25 cm (18×0.50×10 inch), 3SG100-VBX467 (sol gel alumina abrasive grain) wheels (obtained from Norton Company, Worcester, Mass.) operating at 30 surface meters/second (6000 surface feet/minute) during dressing, at an infeed of 0.013 mm (0.0005 inch) per pass after the initial form dressing (0.025 mm (0.001 inch) per pass). No wear of the abrasive component of the dresser was observed after 12 weeks of continuous operation. This compares favorably to a typical commercial rotary dressing tool used in this commercial setting which has measurable wear after 6 weeks of continuous operation. In addition, about 50% improvement in grinding wheel productivity was observed due to the sharpness of the rotary dressing tool.

The 0.12 mm (0.005 inch) tip radius tool was tested in the same commercial setting and has shown very little measurable wear after 5 weeks of continuous operation (i.e., about 2 microns per day).

EXAMPLE 2

A dressing tool was constructed utilizing a 15 cm (6 inch) stainless steel core having slots preformed along the rim into which 0.60-0.71 mm (about 0.025. inch) diameter diamond grains were brazed to yield a tool with a dressing tip radius of 0.3 mm (0.012 inch). The diamond was brazed into the slots using the braze and the method of Example 1. This striped construction had straight sides (0° included angle). The tool was effective in dressing profiles into vitrified bonded CBN wheels.

What is claimed is:

1. A rotary profile dressing tool comprising:

a rigid, disc-shaped core comprising:

an inner portion having a substantially uniform thickness; and a tapered backing portion extending from the inner portion and extending circumferentially around an outer perimeter of the inner portion, wherein the tapered portion comprises a first surface and a second surface and an angle between the first surface and the second surface defines an angle at an outermost point of the tapered backing portion within a range between about 15° and about 30°; and an abrasive rim defining an outer perimeter of the tool and connected to the first surface of the tapered backing portion, the first surface extending substantially orthogonal to an axis of rotation of the tool, and wherein the abrasive rim is further connected to a first surface of the inner portion, the first surface of the tapered backing portion and the first surface of the inner portion connected at a substantially orthogonal angle relative to each other and defining a recess containing the abrasive rim, and further wherein the abrasive rim comprises a plurality of diamond film inserts.

2. The rotary profile dressing tool of claim 1, wherein the abrasive rim is bolted to the core.

3. The rotary profile dressing tool of claim 1, wherein the abrasive rim has a dressing tip radius that remains substantially constant as the tool is used.

4. The rotary profile dressing tool of claim 1, wherein, at any given point around the outer perimeter of the tool, the abrasive component presents a single cutting point to the profiled grinding wheel during truing and dressing.

5. The rotary profile dressing tool of claim 1, wherein the abrasive rim has a thickness within a range of 100 microns to 1,000 microns.

6. The rotary profile dressing tool of claim 1, wherein the core includes a central hole for mounting the rotary profile dressing tool.

7. The rotary profile dressing tool of claim 6, wherein the core includes a number of holes around the central hole for attaching the core to a support element.

8. A rotary profile dressing tool for truing and dressing a profiled abrasive grinding wheel, the rotary dressing tool comprising:

a rigid, disc-shaped core comprising:

an inner portion of the core having a substantially uniform thickness; and an outer perimeter portion of the core extending from the inner portion and extending circumferentially around an outer perimeter of the inner portion, wherein the outer perimeter portion has a tapered shape comprising a first surface and a second surface and an angle between the first surface and the second surface defining an angle at an outermost point of the outer portion within a range between about 15° and about 30° ; and an abrasive rim defining an outer perimeter of the tool and connected to the first surface of the outer perimeter portion, the first surface extending substantially orthogonal to an axis of rotation of the tool, and wherein the abrasive rim is further connected to a first surface of the inner portion, the first surface of the outer perimeter portion and the first surface of the inner portion connected at a substantially orthogonal angel relative to each other and defining a recess containing the abrasive rim, and further wherein the abrasive rim comprises an active braze and diamond grains arranged in single layer.

9. The rotary profile dressing tool of claim 8, wherein the inner portion of the core and the outer perimeter portion of the core are of a unitary construction.

10. The rotary profile dressing tool of claim 8, wherein the active braze comprises a mixture of copper, tin, and titanium.

11. The rotary profile dressing tool of claim 10, wherein the active braze comprises 55 wt % to 70 wt % copper, 15 wt % to 25 wt % tin and 6 wt % to 20 wt % titanium.

12. The rotary profile dressing tool of claim 11, wherein the active braze further comprises silver.

13. The rotary profile dressing tool of claim 8, wherein the active braze comprises 60 wt % to 92.5 wt % nickel, 5 wt % to 10 wt % chromium, 1 wt % to 4.5 wt % boron, 1 wt % to 8 wt % silicon and 0.5 wt % to 5 wt % iron.

14. The rotary profile dressing tool of claim 13, wherein the active braze comprises 0.1 wt % to 10 wt % tin.

15. The rotary profile dressing tool of claim 8, wherein the core includes one or more materials selected from a group consisting of steel, tungsten carbide, iron, cobalt, and composites thereof.

16. The rotary profile dressing tool of claim 15, wherein the composites include ceramic particles or fibers included in a metal matrix continuous phase.

* * * * *